US005682768A

United States Patent [19]

Nissenbaum

[11] Patent Number: 5,682,768

[45] Date of Patent: Nov. 4, 1997

[54] JEWELRY RING WITH HINGED RING SEGMENTS

[75] Inventor: Chaim Nissenbaum, 166-25 Powells Cove Blvd., Whitestone, N.Y. 11357

[73] Assignee: Chaim Nissenbaum, Whitestone, N.Y.

[21] Appl. No.: 626,637

[22] Filed: Apr. 1, 1996

[51] Int. Cl.[6] ..... A44C 9/00

[52] U.S. Cl. ..... 63/15.1; 63/28; 63/15.2

[58] Field of Search ..... 63/15.1, 15.2, 63/15.3, 26, 28, 29.1, 31

[56] References Cited

U.S. PATENT DOCUMENTS

| | | | |
|---|---|---|---|
| 1,936,604 | 11/1933 | Moldenhauer . | |
| 2,016,492 | 10/1935 | Granat | 63/15.1 |
| 2,182,876 | 12/1939 | Moldenhauer . | |
| 2,241,165 | 5/1941 | Shelton | 63/15 |
| 2,408,982 | 11/1946 | Koenig . | |
| 2,472,893 | 11/1949 | Gerson . | |
| 5,003,678 | 4/1991 | Oganesyan | 63/15 X |
| 5,027,617 | 7/1991 | Bonchek . | |
| 5,253,490 | 10/1993 | Doganay . | |
| 5,353,608 | 10/1994 | Berkowitz . | |
| 5,419,158 | 5/1995 | Sandberg et al. . | |
| 5,428,974 | 7/1995 | Shinohara . | |

FOREIGN PATENT DOCUMENTS

| | | | |
|---|---|---|---|
| 0321629 | 6/1989 | European Pat. Off. | 63/3 |
| 2 705 539 | 5/1993 | France . | |

*Primary Examiner*—Kien T. Nguyen

*Attorney, Agent, or Firm*—Levisohn, Lerner, Berger & Langsam

[57] ABSTRACT

A main, center ring is provided with at least one hinged, ring segment. Preferably, the main, center ring is split into two ornamental hives. One or more ring segments are hingedly connected to the ring halves. In this manner, the wearer can selectively rotate the ring segment(s) so that it is (they are) adjacent to either of the ring halves of the main, center ring to provide the wearer with a variety of visual appearances.

25 Claims, 3 Drawing Sheets

FIG. 1
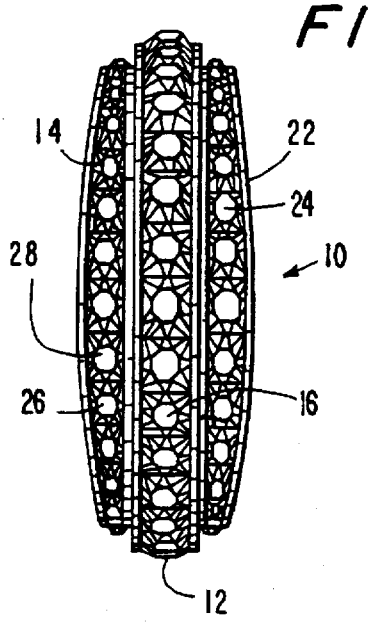
FIG. 2
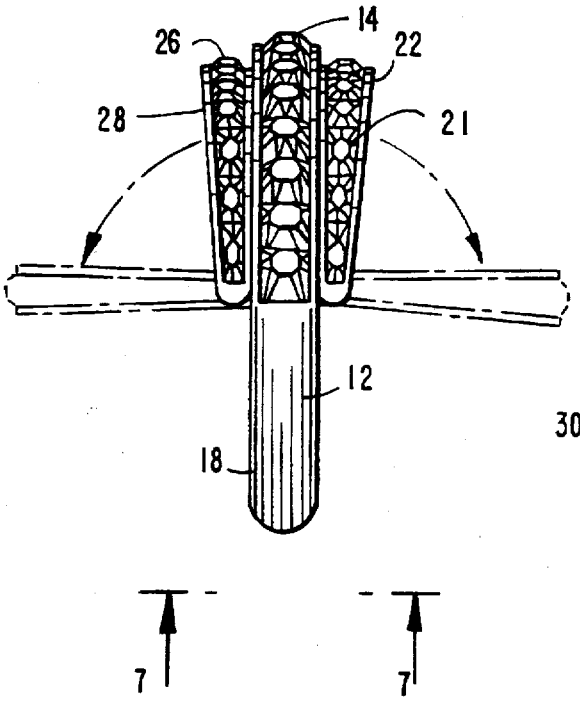
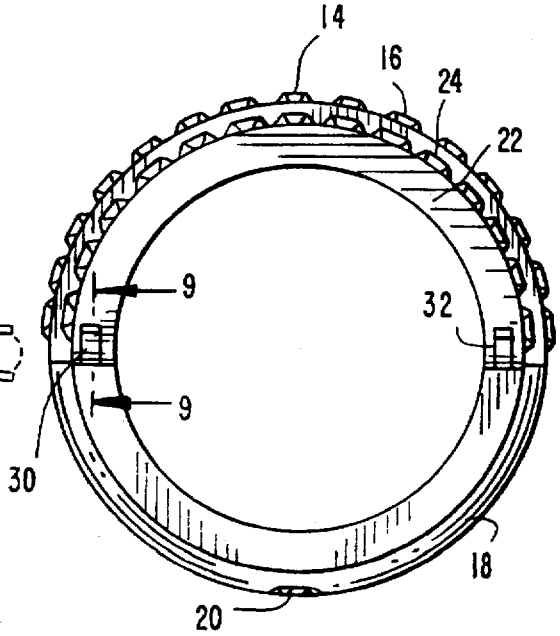
FIG. 3

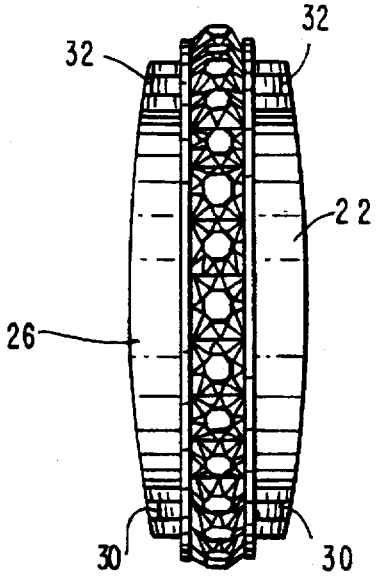
FIG. 4
FIG. 5
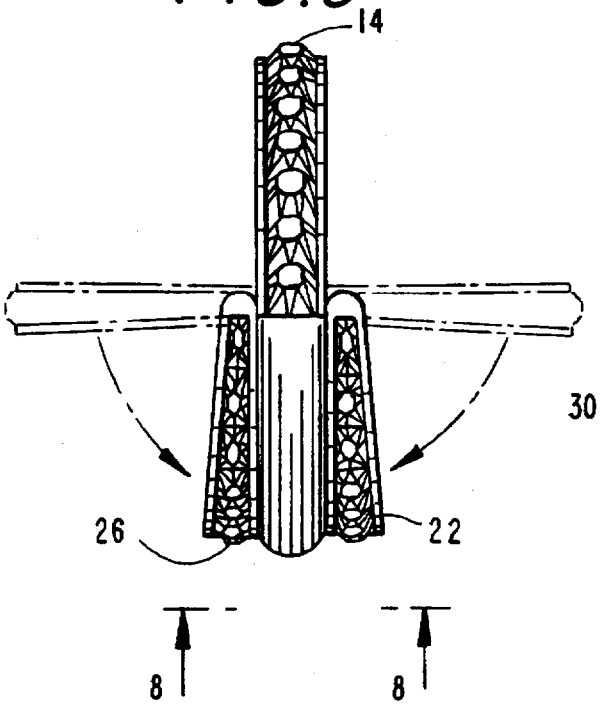
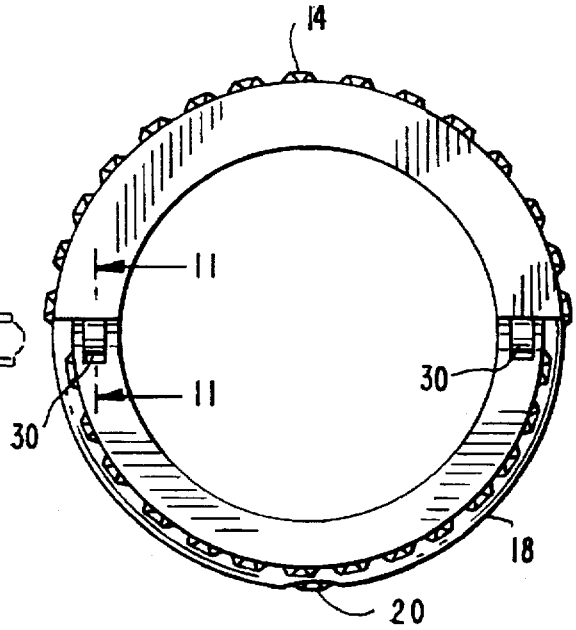
FIG. 6

FIG. 7
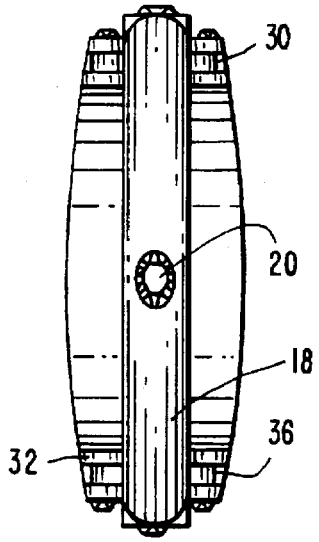
FIG. 8
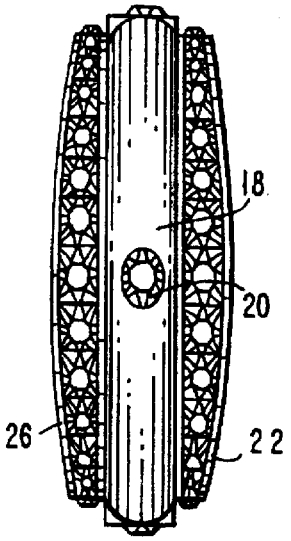
FIG. 9
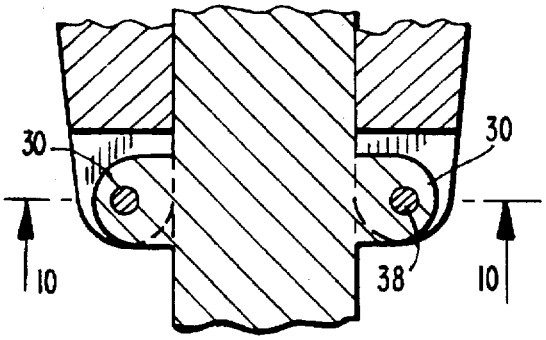
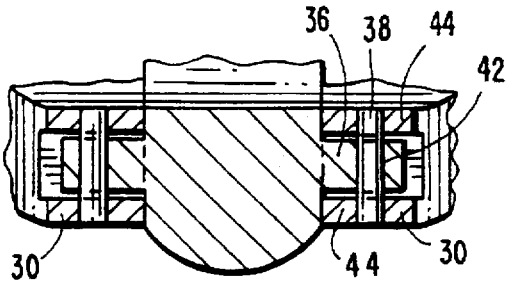
FIG. 10
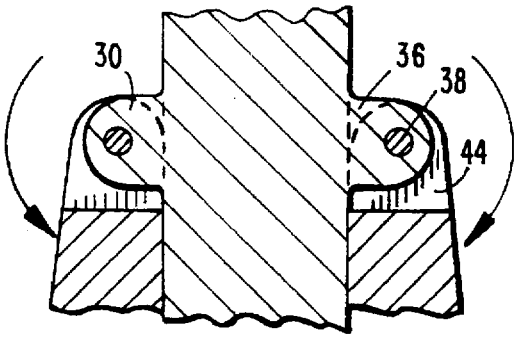
FIG. 11

JEWELRY RING WITH HINGED RING SEGMENTS

FIELD OF THE INVENTION

The present invention relates to jewelry items. More specifically, the present invention relates to a jewelry ring with hinged ring segments. The hinged ring segments provide the wearer with a large variety of options to provide many different "looks" for a single ring.

BACKGROUND OF THE INVENTION

Rings are popular items of jewelry which have been worn by women and men for centuries. Generally, rings are made out of solid material and are of a non-mechanical construction. The most common form of ring constitutes a simple metallic band fitted for the finger. More elaborate rings have been made to contain precious or semi-precious gems, engravings, and so forth.

Several different mechanical ring constructions which depart from those conventional and simple ring designs have been introduced into the prior art, however. U.S. Pat. No. 2,182,876 to Moldenhauer discloses a modified ring construction in which an inner segment of the ring affords a surface on which the marriage vow (in the case of a wedding ring) or another legend may be inscribed. The surface is concealed and protected by the movement of the inner portion of the ring into a position such that, when nested, only the outer portion of the ring is visible. Thus, when nested, the construction provides the appearance of a single ring worn on the finger. The disclosure indicates that the inner portion of the ring with the inscribed surface can be articulated out of register to permit one to read the inscription. The inner, articulated portion is normally located beneath the outer band of the ring and intended to be concealed from view during wearing. This inner ring, as inscribed, is therefore not seen while the ring is normally worn. In this way, the ring only presents a single ornamental appearance when worn on the finger. U.S. Pat. No. 1,936,604, also to Moldenhauer, discloses a similar ring construction with a slightly different mechanism for concealing the inner ring inside the outer ring.

U.S. Pat. No. 5,253,490 to Doganay discloses a jewelry ring with a pair of ring jackets having a hinge at their base. The disclosed ring construction has two rings for jacketing a separate ring. The ring jacketing device can be worn by itself. Alternatively, the ring jackets provide a slot in which a third, separate, ring body is inserted to form a different design. The separate ring can have a gem mounted thereon.

U.S. Pat. No. 2,472,893 to Gerson discloses twin finger rings which can be worn separately or joined to be worn together. It is stated that an objective is to provide a twin ring combination which will effect a secure locking of the elements without the use of levers, hooks or screw members. The female elements of the locking component of the rings are each provided with a dove-tail like channel to slidably accommodate a male element.

U.S. Pat. No. 2,408,982 to Koenig discloses a ring, preferably for a solitaire gem, having a wedding band segment secured thereto. An annular groove in the solitaire ring allows the band segment to rotate. The wedding band segment may be rotated along the groove to lie contiguous with the ring with the solitaire, or may be positioned in a diametrically opposed position. In both positions, the wedding band and the ring are not flush against one another, but rather the wedding band is held at an angle to the main ring and seems barely visible because of the solitaire and the main ring blocking its view.

U.S. Pat. No. 5,027,617 to Boncheck and U.S. Pat. No. 5,419,158 to Sandberg et al. disclose additional combination ring constructions, as well. U.S. Pat. Nos. 5,353,608; 5,428,974; and French Patent Application No. 2,705,539 also relate to rings which, in various manners, seek to provide different appearances to the wearer.

Accordingly, there is a long standing interest in the art for ring constructions allowing an owner to own a single article of jewelry, to be worn on a finger, which can be adapted to present an entire series of different appearances. There is also a need in the art for a unitary, hinged, jewelry ring which can be manipulated by the user, and which can show a variety of different surfaces or "looks" to a viewer when the ring is worn on the user's finger. Allowing the wearer to select one of a plurality of appearances achieves greater versatility to the wearer so that the selected ring design to be displayed can coordinate with the wearer's mood, the fashion and/or the occasion. A single ring having a variety of different displayable surfaces also allows an individual to purchase only one ring, while wearing the equivalent of many different ones.

SUMMARY OF THE INVENTION

It is an object of the present invention to provide a ring construction which can be adapted to present a series of different appearances or "looks" to a viewer.

It is a further object of the present invention to provide an integral or unitary jewelry ring construction which is versatile in its appearance and can be easily manipulated by the user to present a variety of "looks".

It is a further object of the present invention to provide a hinged ring having ring segments which can rest flush against the main ring to allow viewers of the wearer to see the main center ring and the ring segments, as well.

It is a further object of the present invention to provide a hinged jewelry ring having ring segments which can be rotated to present many different design views.

It is a further object of the present invention to provide a single, hinged jewelry ring comprised of a main complete ring and, in the preferred embodiment, divided into two halves of different visual appearance and at least one ring segment which can provide at least four different visual appearances. In the preferred embodiment, the main ring is provided with two ring segments.

The objects of the present invention are accomplished by providing a ring construction having a main ring divided into ring halves and at least one but preferably two ring segments attached to the main center ring. The ring segments rotate around hinges to alternatively and selectively present the ring segments about each of the two halves of the main center ring in any one of a variety of orientations. Thus, the ring can be easily manipulated by the user to present a variety of different appearances. One half of the central ring can be adorned the same as or differently than the other half, increasing the variety of appearances which can be presented by the ring. In this manner, a single article of jewelry is provided which can be manipulated by the user to allow the wearer to change the presented ring appearance, as desired.

BRIEF DESCRIPTION OF THE DRAWINGS

FIG. 1 shows a front view of a hinged jewelry ring in accordance with the present invention, in which the main or center ring is sandwiched between the two side ring segments.

FIG. 2 shows a right side view of the hinged jewelry ring of FIG. 1, rotated 90° C. The hinged jewelry ring is shown in the configuration of FIG. 1, with dotted outlines showing the movement of the side ring segments as they rotate so that they can sandwich the second half of the main center ring, to allow the first half of the main center ring to be displayed alone or to allow the second half of the main center ring to be displayed, as sandwiched between the side ring segments.

FIG. 3 shows a bottom view of the hinged jewelry ring with the side ring segments in the orientation shown in FIG. 1, again, rotated 90° from that shown in FIG. 1.

FIG. 4 shows a from view of the hinged ring in a second orientation, with both side ring segments rotated into the position so that they sandwich the second half of the main center ring. This is basically the same view as FIG. 1 with the ring segments flipped back so that they sandwich the second half of the main ring.

FIG. 5 shows a side view of the orientation of the hinged ring of FIG. 4, rotated 90° C. and, in dotted outline shows how the side ring segments complete their rotation from the position shown in FIG. 2 to that of FIGS. 4, 5 and 6.

FIG. 6 is a bottom view of the hinged jewelry ring shown in FIGS. 4 and 5, with the side ring Segments in the orientation of FIG. 4.

FIG. 7 is a rear view of the hinged jewelry ring of FIG. 1. This shows a third "look" of the jewelry article. FIG. 7 is also a view of the hinged jewelry ring of FIG. 2, along the lines 7—7 shown in FIG. 2, wherein both side ring segments are flush with the first haft of the main, center ring.

FIG. 8 is a rear view of the hinged jewelry ring in the orientation of FIG. 4. FIG. 8 is a view of the hinged ring of FIG. 5, taken along lines 8—8 shown in FIG. 5.

FIG. 9 is an enlarged, partial, inside view of the hinged jewelry ring of the present invention, taken in cross-section along the lines 9—9 shown of FIG. 3, and with both side ring segments adjacent the first half of the main, center ring.

FIG. 10 is an enlarged, partial view of the hinged jewelry ring, taken in cross-section along the lines 10—10 shown in FIG. 9.

FIG. 11 is an enlarged, partial inside view of the hinged jewelry ring of the present invention, taken in cross-section along the lines 11—11 shown of FIG. 6, and with both side ring segments adjacent the second half of the main, center ring.

DETAILED DESCRIPTION OF THE PREFERRED EMBODIMENT AND THE DRAWINGS

As best seen in the drawings, a jewelry ring 10 is provided which can be manipulated to present a variety of different appearances to the wearer. Jewelry ring 10 basically consists of a main, center ring 12 which presents a first half 14 comprised of a series of adjacent, channel set diamonds 16 extending about 180° C. of the ring and a second half 18 which, in the preferred embodiment, is a solid-gold half ring segment also extending about 180° C., with a center-mounted diamond solitaire 20 (see FIGS. 3, 6 and 7). The main center ring 12 is suitably sized to fit on the wearer's finger and is a solid ring which can, if desired, present the diamond solitaire look, held in the solid gold, second half 18. The diamond solitaire in second half 18 need not be provided to display a very simple and traditional wedding band. Selectively, the ring can be rotated 180° C. about the wearer's finger so that the first half 14 of the wain, center ring is shown, displaying the channel set diamonds 16. In the embodiment shown, first half 14 of main center ring 12 and second half 18 differ in their visual display. These halves of the main ring can differ in their sculpture, in the types, positions or styles of the gems placed thereon, in their engravings, or so forth, such that the first half 14 and second half 18 have different appearances to a viewer. Similarly, whereas the ring segments 22 and 26 (described in greater detail hereafter) are described in terms of having diamonds thereon, any other adornment, gems, sculpture or so forth can be used to provide an attractive appearance. They can be the same or different from one another. If the main ring is split into two halves of different visual appearances, with but one ring segment, four distinct "looks" are achieved. With main, center ring being uniform around 360° C., use of two hinged, ring segments of different visual display will result in four potential looks, too.

A first ring segment 22 is hingedly connected to the main, center ring 12 and basically comprises a rotatable half ring portion. In the preferred embodiment of the present invention, the first ring segment 22 is provided with channel set, prong or pavé diamonds 24.

A second ring segment 26 is also hingedly connected to the main, center ring 12 and it, too, can be provided with channel set, prong set, or pavé diamonds 28. Both fast ring segment 22 and second ring segment 26 are hingedly connected to main, center ring 12 by pairs of hinges 30 and 32. First ring segment 22 is connected by a fast pair of hinges 30, 32 and second ring segment 26 is connected by a second pair of hinges 30 and 32. According to the invention, the first ring segment 22 and the second ring segment 26 sandwich or flank either half 14 or 18 of the main center ring 12. The hinges of the ring segments are proximal to the nominal diameter of the main, center ring which divides the same into the first and second halves. Due to the fact that the ring segments 22 and 26 are rotatable about hinges 30 and 32, respectively, each of the ring segments 22 and 26 can flank either first half 14 of main center ring 12 or second half 18.

Thus, when moved together, both ring segments 22 and 26 can be placed to flank fast half 14 of main, center ring 12, with the row of diamonds 16 (as shown in FIGS. 1 and 2) or, alternatively, the first ring segment 22 and second ring segment 26 can sandwich the second half 18 of the main, center ring 12 with its solitaire diamond 20 (as shown in FIGS. 4 and 5). As can be seen from the Figures, this ability to rotate a ring segment or both segments together results in at least four different appearances (where the main, center ring 12 is split into decorative halves 14 and 18 of different visual presentations) even if only one ring segment is provided. With main, center ring split into different decorative halves, as shown, and two ring segments of identical visual look, keeping both ring segments on the same side of the main, center ring, four "looks" can be presented to a viewer, depending on which half of the main center ring 12 is shown, and whether the ring segments 22 and 26 flank the first half of the center ring or the other half. In addition, the ring segments 22 and 26 can be moved singly, instead of in pairs, to provide yet additional appearances, although for visual attractiveness and symmetry, moving the ring segments 22 and 26 in pairs is preferred. Alternatively, of course, the ring segments can present different appearances from one another, e.g., one ring segment 22 can be a row of rubies and the other ring segment 26 can be sapphires. Eight "looks" are then possible where the main, center ring is split into decorative halves, the ring segments are different and not necessarily held on the same half together as the main, center ring.

As best seen in FIGS. 9, 10 and 11, each of hinge pairs 30 and 32 consists of an ear 36 extending outwardly from the main, center ring 12 at or about the middle diameter line serving to divide the main, center ring into the first half 14 and the second half 18. Each ear 36 is provided with a hole 42. Each ring segment 22 and 26 is provided at both ends, with a pair of spaced tabs, 44, spaced apart slightly more than the thickness of the ear 36 of the main, center ring. A pin 38 is provided to pass through a hole in each of tabs 44 (and then soldered in place) and through the hole 42 of ear 36. This provides a typical hinged construction. In this manner, as will be appreciated by those of ordinary skill in the art, the ring segments 22 and 26 are capable of independently, hingedly rotating. The ring segments 22 and 26 can rotate to a first position so that each ring segment is adjacent to a first half 14 of the main, center ring 12 or, alternatively, each ring segment can independently rotate so that the ring segments 22 and 26 are adjacent to or sandwiching the second half of the main, center ring. In this manner, a variety of ornamental appearances are provided. So More specifically, as seen in FIG. 1, the ring segments 22 and 26 can be provide so that they are adjacent to and sandwiching the fast half 14 of the main, center ring 12 with the plurality of channel set, prong set or pavé diamonds 16 on the center ring 12, and the diamonds 24 and 28 (on the ring segments 22 and 26, respectively) all visible. In this manner, a very attractive fast ring design is capable of being displayed on the wearer's finger. With the ring segments in this orientation, the ring can also be rotated about the wearer's finger, 180° C., to provide a very different appearance in which only the second half 18 of the main, center ring 12 is visible. This will display the solid gold second half 18 with the diamond solitaire 20, as best shown in FIG. 7.

Alternatively, however, the wearer can rotate about the hinges both ring segments (or only one ring segment, if desired) so that the ring segments sandwich the second half 18 (with diamond solitaire 20) of the main, center ring 12. In this manner, two additional ring designs are capable of being displayed. In this orientation of the ring segments 22 and 26, best shown in FIGS. 4, 5 and 8, the ring segments 22 and 26, with channel set, prong set or pavé diamonds, sandwich the solid gold second half 18 with the diamond solitaire 20 and present a very pleasing appearance (See FIG. 8). Rotating the ring, however, about the wearer's finger, 180° C., without changing the ring segments' positions will allow the main, center ring 12 and, specifically, the first half thereof with the channel set row of diamonds 16 to be visible (see FIG. 4). Thus, it should be appreciated by one of ordinary skill in the an that the ring segments in this orientation provide the wearer with two additional display appearances.

Thus, according to the present invention, a single, main, center ring, which is split into two decorated halves, and further provided with one or two ring segments which are hingedly connected to the main, center ring, provides for at least four discreet "looks" and possibly eight "looks". While it is within the contemplation of the inventor that each ring segment be visually different and can be rotated about its hinges by itself, without corresponding rotation of the other ring segment, it is the contemplation of the inventor, for the preferred embodiment, for aesthetic purposes, that the ring segments be identical and on the same side, i.e., together flank and sandwich either half of the main, center ring.

Having described this invention with regard to specific embodiments, it is to be understood that the description is not meant as a limitation since further variations or modifications may be apparent or may suggest themselves to those skilled in the an. It is intended that the present application cover such variations and modifications as fall within the scope of the appended claims.

I claim as follows:

1. A jewelry ring comprising:

a main, center ring; and at least one ring segment, having a visual appearance, hingedly connected to said main, center ring, said ring segment capable of being rotated about its diameter to flushly rest against an outer edge of said main, center ring selectively in one of two distinct positions.

2. A jewelry ring as claimed in claim 1, wherein said main, center ring is provided with two of said ring segments.

3. A jewelry ring as claimed in claim 2, wherein said ring segments present a different visual appearance from one another.

4. A jewelry ring as claimed in claim 2, wherein said ring segments present a visual appearance the same as one another.

5. A jewelry ring as claimed in claim 1, wherein said main, center ring is formed of two halves, each half comprising a different visual appearance from one another.

6. A jewelry ring as claimed in claim 3, wherein said two halves of said main, center ring comprise a first half comprising a row of diamonds and a second half comprising a gold band.

7. A jewelry ring as claimed in claim 6, wherein said gold band is provided with a diamond solitaire.

8. A jewelry ring as claimed in claim 1, wherein at least one of said ring segments is provided with a row of gems.

9. A jewelry ring as claimed in claim 8, wherein said row of gems are precious or semi-precious stones.

10. A jewelry ring as claimed in claim 8, wherein said row of gems are channel set.

11. A jewelry ring as claimed in claim 1, wherein at least one half of said main, center ring is provided with a row of diamonds.

12. A jewelry ring as claimed in claim 1, wherein at least half of said main, center ring comprises a row of channel set gems.

13. A jewelry ring as claimed in claim 12, wherein said row of channel set gems are diamonds.

14. A jewelry ring according to claim 1, wherein a first of said distinct positions is 180° C. around from a second of said distinct positions.

15. A jewelry ring according to claim 1, wherein said ring segment is hingedly connected to rotate substantially about a diameter of said main, center ring.

16. A jewelry ring according to claim 15, further comprising two hinges, mounted on diametrically opposed locations of said main, center ring, for hingedly connecting said ring segment to said main, center ring.

17. A jewelry ring according to claim 1, further comprising two hinges, mounted on diametrically opposed locations of said main, center ring, for hingedly connecting said ring segment to said main, center ring.

18. A jewelry ring comprising:

a center ring formed of two semicircular halves, each of said halves being of a different visual appearance from the other; and two ring segments, each of said ring segments being attached to said center ring at the nominal diameter of said center ring where said two semicircular halves meet each other, and said ring segments being capable of individual, selective rotation substantially about said nominal diameter to flushly rest against either of said halves.

19. A jewelry ring as claimed in claim 18, wherein at least one of said halves is provided with gems.

20. A jewelry ring as claimed in claim 18, wherein at least one of said ring segments is provided with gems.

21. A jewelry ring as claimed in claim 18, wherein one of said halves is provided with a row of diamonds and the other of said halves is provided with a single diamond solitaire set in gold, and said ring segments are each provided with a row of gems.

22. A jewelry ring as claimed in claim 21, wherein said row of gems are diamonds.

23. A jewelry ring as claimed in claim 21, wherein said row of gems on each of said ring segments present the same visual appearance.

24. A jewelry ring as claimed in claim 21, wherein said row of gems on each of said ring segments present a different visual appearance.

25. A jewelry ring according to claim 18, further comprising four hinges, mounted on diametrically opposed locations of said center ring at said nominal diameter where said two halves meet each other and on opposite sides of said center ring, for hingedly connecting said ring segments to said center ring.

* * * * *